US007007427B2

(12) United States Patent
Sanke et al.

(10) Patent No.: US 7,007,427 B2
(45) Date of Patent: Mar. 7, 2006

(54) SEPARATING DEVICE FOR AN OVERHEAD DOOR

(75) Inventors: Michael Sanke, Rheda-Wiedenbrück (DE); Viktor Schütz, Arnsberg (DE)

(73) Assignee: Hörmann KG Antriebstechnik, Halle (DE)

( * ) Notice: Subject to any disclaimer, the term of this patent is extended or adjusted under 35 U.S.C. 154(b) by 0 days.

(21) Appl. No.: 10/202,484

(22) Filed: Jul. 24, 2002

(65) Prior Publication Data

US 2003/0019157 A1 Jan. 30, 2003

(30) Foreign Application Priority Data

Jul. 25, 2001 (DE) ..... 201 12 283 U

(51) Int. Cl.
*E05F 15/16* (2006.01)

(52) U.S. Cl. ..... 49/199; 49/139; 49/140

(58) Field of Classification Search ..... 49/337, 49/139, 140, 199, 333, 334, 335; 74/425, 74/405, 421 A, 625; 160/188, 310
See application file for complete search history.

(56) References Cited

U.S. PATENT DOCUMENTS 2,574,204 A * 11/1951 Woody et al. ..... 192/93 A
2,588,028 A 3/1952 McNinch
3,343,302 A * 9/1967 Browning et al. ..... 49/18
3,745,705 A * 7/1973 Reddy ..... 49/139
4,055,023 A * 10/1977 Gatland et al. ..... 49/28
4,191,237 A * 3/1980 Voege ..... 160/188
4,452,292 A * 6/1984 Leivenzon et al. ..... 160/133
4,605,108 A * 8/1986 Monot ..... 477/8
4,706,727 A * 11/1987 Leivenzon et al. ..... 160/188
4,750,294 A * 6/1988 Lafontaine ..... 49/28
4,821,456 A * 4/1989 Nogaki ..... 49/362
4,904,006 A * 2/1990 Hayakawa et al. ..... 292/336.3
4,976,168 A * 12/1990 Lotznicker et al. ..... 74/625
5,148,631 A * 9/1992 Bayard et al. ..... 49/449
5,243,784 A * 9/1993 Whitaker et al. ..... 49/199
5,341,598 A * 8/1994 Reddy ..... 49/362
5,524,859 A * 6/1996 Squires et al. ..... 248/551
5,557,887 A * 9/1996 Fellows et al. ..... 49/28
5,722,272 A * 3/1998 Bridgeman et al. ..... 70/264
5,862,692 A * 1/1999 Legault et al. ..... 70/278.1
6,009,668 A * 1/2000 Reddy ..... 49/280
6,019,402 A * 2/2000 Arabia et al. ..... 292/216
6,053,543 A * 4/2000 Arabia et al. ..... 292/201
6,089,058 A * 7/2000 Elpern et al. ..... 70/279.1
6,094,867 A * 8/2000 Reddy ..... 49/280
6,108,977 A * 8/2000 Payne et al. ..... 49/360
6,116,110 A * 9/2000 Maue et al. ..... 74/471 R (Continued)

FOREIGN PATENT DOCUMENTS

EP 0565061 3/1997

(Continued)

*Primary Examiner*—Gregory J. Strimbu
(74) *Attorney, Agent, or Firm*—Friedrich Kueffner

(57) ABSTRACT

A separating device for a door leaf that is moveable overhead has a coupling element movable between a coupling position, in which the coupling element couples an output element of the drive device to the structural component, and a freewheeling position, in which the output element of the drive device is decoupled from the structural component. A locking member is provided which is movable between at least one release position, in which the locking member allows a movement of the coupling element into the freewheeling position, and at least one locking position, in which the locking member counteracts a movement of the coupling element into the freewheeling position. The locking member can be coupled to the drive device.

9 Claims, 4 Drawing Sheets

U.S. PATENT DOCUMENTS 6,125,583 A * 10/2000 Murray et al. ..... 49/291
6,133,703 A * 10/2000 Fitzgibbon et al. ..... 318/445
6,208,103 B1 * 3/2001 Kachouh ..... 318/468
6,282,931 B1 * 9/2001 Padiak et al. ..... 70/279.1
6,308,587 B1 * 10/2001 Shinkawa et al. ..... 74/89.25
6,341,448 B1 * 1/2002 Murray et al. ..... 49/280
6,349,983 B1 * 2/2002 Dupont et al. ..... 292/201
6,386,599 B1 * 5/2002 Chevalier ..... 292/201
6,435,600 B1 * 8/2002 Long et al. ..... 296/155
6,494,505 B1 * 12/2002 Kobayashi et al. ..... 292/201
6,497,436 B1 * 12/2002 DeBlock et al. ..... 292/216
6,511,106 B1 * 1/2003 Perkins et al. ..... 292/216
6,530,863 B1 * 3/2003 Balli et al. ..... 475/149
6,550,825 B1 * 4/2003 Ostrowski et al. ..... 292/199
6,554,329 B1 * 4/2003 DeBlock et al. ..... 292/216
6,561,255 B1 * 5/2003 Mullet ..... 160/188
6,564,510 B1 * 5/2003 Juntunen et al. ..... 49/103
6,575,277 B1 * 6/2003 Torii et al. ..... 192/12 B

FOREIGN PATENT DOCUMENTS

EP 1028215 8/2000

* cited by examiner

SEPARATING DEVICE FOR AN OVERHEAD DOOR

BACKGROUND OF THE INVENTION

1. Field of the Invention

The invention relates to a separating device for a drive device that can be coupled to a movable structural component, such as a door leaf movable overhead, the separating device comprising a coupling element movable between a coupling position, in which it couples an output element of the drive device to the structural component, and a freewheeling position, in which the output element is decoupled from the structural component, and further comprising a locking member movable between at least one release position, in which it allows a movement of the coupling element into a freewheeling position, and at least one locking position, in which it counteracts a movement of the coupling element into the freewheeling position. The invention furthermore relates to a drive device provided with such a separating device as well as a door provided with such a drive device.

2. Description of the Related Art

Separating devices of the aforementioned kind are used in particular for operating electrically driven door leafs of garage doors or shop doors that are movable overhead. Drive devices for factory doors or shop doors with especially large and heavy door leafs are comprised generally of an electric motor and a gear with a greatly geared down transmission ratio which enables movement of heavy door leafs with electric motors of comparatively low power. Should the electric motor be inoperative because of a power outage or a defect, the door leaf must generally be decoupled from the drive device in order to enable a quick movement of the door leaf between its closed position and open position with a minimal force expenditure because the gear arranged between the electric motor and the door leaf is generally provided with a strong self-locking action counteracting this movement. For this reason, the drive device is coupled by means of a coupling element, movable between the coupling position and the freewheeling position, to the door leaf or a drive shaft for the door leaf. However, in order to protect the user of such doors, it must be ensured that the door leaf, upon movement of the coupling element into the freewheeling position, does not immediately drop into its closed position and thereby injure the user. For this reason, conventional separating devices of the aforementioned kind, as described in European patent 0 565 061 B1, are provided with a locking member which counteracts a movement of the coupling element into the freewheeling position and enables this movement only in a predetermined release position.

In the separating device described in the aforementioned document, the locking member is in the form of a lever which is supported to be rotatable about a predetermined axis and which engages in the locking position a circumferential groove of an actuating bolt for the coupling element and, in this way, prevents a movement of this coupling element into the freewheeling position. In the known device, the locking member is actuated by means of an adjusting member of a path simulator coupled to the drive device which is driven synchronously to the movement of the door leaf and provides a positional representation of the door leaf projected onto a small space. In this way, an actuation of the locking member from the locking position into the release position is carried out every time the adjusting member reaches the position corresponding to the closed position of the door leaf. The path simulator of the known device comprises a spindle coupled to the drive device and comprises a carriage engaging the thread of the spindle by means of a female thread. The carriage is guided on the thread of the spindle so as to be secured against rotation and is movable along the spindle axis. This carriage forms the adjusting member of the path simulator with which the locking member is actuated upon reaching the closed position of the door leaf. For this purpose, the carriage comprises a driver embodied in the form of a leaf spring which engages the locking member upon reaching the closed position of the door leaf.

With this arrangement it is possible to move the coupling element only into the freewheeling position when the door leaf is in the closed position, in which it rests on the floor of the room to be closed, while a movement of the coupling element otherwise is prevented by means of the locking member.

When using this known separating device comprising a locking member and a path simulator it was however found that a movement of the coupling element into a freewheeling position, even upon reaching the closed position of the door leaf, in particular after an extended time of operation or use of the door, is possible in some cases only with increased force expenditure or is not possible at all.

SUMMARY OF THE INVENTION

It is an object of the present invention to provide a separating device of the aforementioned kind with which the movement of the coupling element upon reaching a predetermined position of the structural component coupled to a drive device can be reliably affected even after an extended time of operation or use.

In accordance with the present invention, this is achieved in that the locking member itself can be coupled to the drive device.

The invention is based on the recognition that the problems observed in the prior art are primarily based on the fact that the actuation of the locking member by means of an adjusting member coupled to the drive device is particularly susceptible to failure because the contact surfaces of the adjusting member and of the locking member, which are contacted with one another upon actuation of the device, show signs of wear after an extended time of use. This can have the result that the locking member is no longer reliably actuated for release of the separating process. This wear process is favored in the known devices particularly in that the contact surfaces of the adjusting member, on the one hand, and of the locking member, on the other hand, will come to rest against one another upon each movement of the door leaf into the locked position. This deficiency is eliminated with the separating device according to the invention in that the locking member itself is coupled to the drive device and therefore is moved automatically into the release position, without intermediate positioning of a path simulator, upon movement of the structural component without this requiring a contact between the locking member and a further element driven by the drive device which then causes the above described wear effects.

In this connection it is particularly advantageous that, in comparison to the known separating devices, an increased operational reliability with simultaneous simplification of the configuration of the separating device is achieved wherein the simplification is substantially achieved in that the path simulator required in the known separating devices is no longer needed in the separating device according to the invention. Expediently, the locking member is coupled to the drive device such that when the structural component reaches a predetermined position, for example, upon reaching the closed position of the door leaf, the locking member automatically reaches the release position. In this connection, the locking member can be configured such that it reaches this release position in more than one position of the structural component, for example, also in the situation when the structural component in the form of a door leaf reaches its overhead open position; in this position, as a result of its horizontal alignment, it cannot drop without external action into the closed position even after separation from the drive device.

Expediently, the locking member is configured such that even after completed movement of the coupling element into the freewheeling position the above described properties will not be lost so that, even for intermittent separation of the drive device from the door leaf, the release position can be reached only in the predetermined positions of the structural component, such as the closed position and the open position of a door leaf movable overhead. This can be achieved particularly easily in that the locking member can be coupled also by means of the coupling element to the output element so that it is automatically entrained when the structural component is manually moved, even after movement of the coupling element into the freewheeling position.

Expediently, the locking member can be coupled by means of a control shaft, used for controlling the drive device, to the output element. Such a control shaft can be used for controlling the drive device when it is connected to a suitable control element such as a rotary potentiometer.

As has been discussed above, the output element is conventionally not coupled directly to the structural component but to a rotatably supported drive shaft for the structural component. In the use of structural components in the form of door leafs, the drive shaft can comprise a cable drum for a traction means, such as a wire cable, secured on the structural component wherein the traction means is wound onto the cable drum during the course of the rotational movement of the drive shaft effected by the drive device and thereby pulls the door leaf from the closed position into the open position.

Since the drive shaft during the course of such an opening movement carries out several revolutions about its shaft axis, it is particularly expedient in the sense of a reliable control of the drive device when the rotational movement of the drive shaft is transmitted by a gear with a geared-down transmission ratio onto the control shaft. Such a geared-down gear can be realized particularly simply in that the control shaft is provided with a gear wheel or worm gear meshing with a rib which is arranged helically on the drive shaft. In this way, it can be achieved that ten or more complete revolutions of the drive shaft are required in order to effect a complete revolution of the control shaft. A transmission of movement from the drive shaft onto the locking member, independent of the geared-down transmission ratio of the transmission of the rotary movement from the drive shaft onto the control shaft, can be achieved when the locking member is coupled to the control shaft by means of a locking member shaft, preferably provided with a spur gear meshing with the gear wheel or the worm gear. In this connection, the locking member is expediently supported to be rotatable about a predetermined axis of rotation, for example, the longitudinal axis of the locking member shaft, and is fixedly connected with the locking member shaft.

In this connection, mounting of the separating device according to the invention can be simplified in that the locking member is rotatable relative to the locking member shaft and can be coupled in any rotational position fixedly with the locking member shaft. In this case, the structural component can be transferred during mounting into that position in which a movement of the coupling element into the freewheeling position is to be made possible and the locking member can be aligned in this position relative to the locking member shaft and subsequently arrested such that it is in the release position. For the purpose of an increased operational reliability of the separating device according to the invention, it was found to be particularly beneficial when the locking member, at least over sections, is moved approximately synchronously to the structural component such that the position of the locking member, at least over one section of the movement path of the structural component, preferably in every phase of the movement of the structural component, is correlated unequivocally with that of the structural component.

As has been explained already supra, the locking member is expediently rotatable about a predetermined axis such as the rotational axis of the locking member shaft. By means of the locking member of the separating device according to the invention an accidental movement of the coupling element can be particularly reliably prevented when the coupling element has correlated therewith a locking element, cooperating with the locking member in its locking position, for counteracting a movement of the coupling element into the freewheeling position. In this connection, the locking member can have a groove extending approximately radially relative to the locking member shaft and the locking element can have a projection which, in the release position of the locking member, can be inserted into this groove and is preferably of a pin shape. The projection, in a position of the locking member which is different from the release position, rests against an outer boundary surface of the preferably disc-shaped locking member and in this way counteracts a movement of the coupling element.

Since in the release position of the locking member usually no movement of the coupling element is desired, it is particularly expedient when in this position the coupling element is moveable into the freewheeling position only against a pretension force. This can be realized particularly simply when the groove bottom has a ramp-shaped upward incline and the pin is moveable against the pretension force of a pretensioning device in a direction approximately perpendicular to the groove bottom so that an introduction of the pin into the groove upon contact of the pin on the groove bottom is possible only against the pretension force of the pretensioning device. Expediently, the locking element is arranged on an actuating device, for example, in the form of a pivotably supported actuating lever, which serves for moving the coupling element. The separating device according to the invention can be embodied particularly compact when the drive element is provided with a worm gear meshing with a worm of a gear of the drive device and revolving about the drive shaft and when the coupling element has a coupling ring which is axially movable and effects in the coupling position a positive-locking connection between the worm gear and the drive shaft. In the coupling position, the coupling ring is arranged between the worm gear and the drive shaft. In this connection, the actuating device can comprise at least one driver engaging a groove arranged peripherally on the coupling ring. As has been explained above, the locking member is mounted in the case of a drive device for a door leaf to be moved overhead expediently such that it is in the release position only when the door leaf is in the closed position and/or the open position of the door leaf.

DESCRIPTION OF THE PREFERRED EMBODIMENTS

Figure 1:
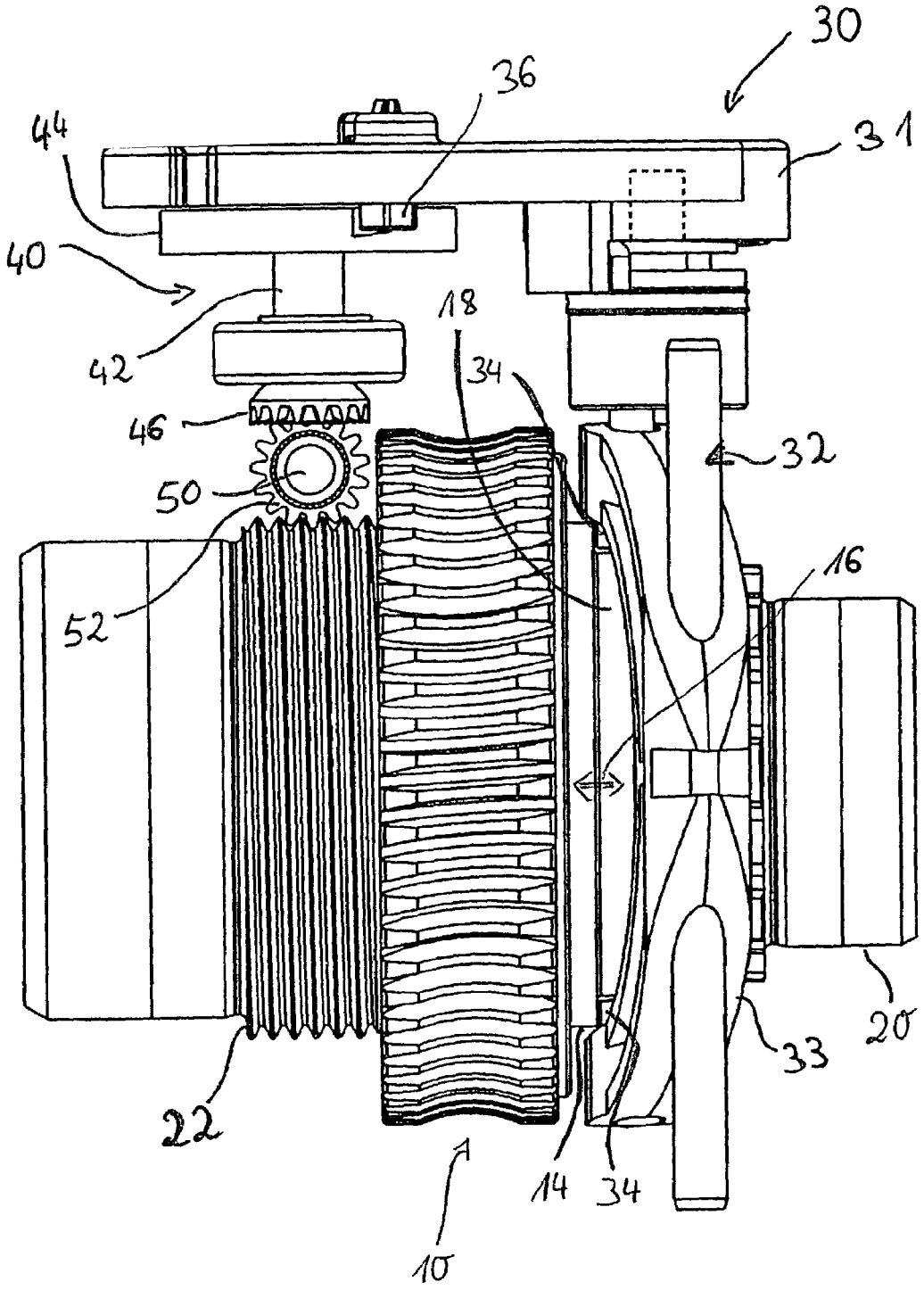
FIG. 1 is a plan view onto a drive device provided with a separating device according to the invention, wherein only the important components of the drive device are illustrated.
Figure 2:
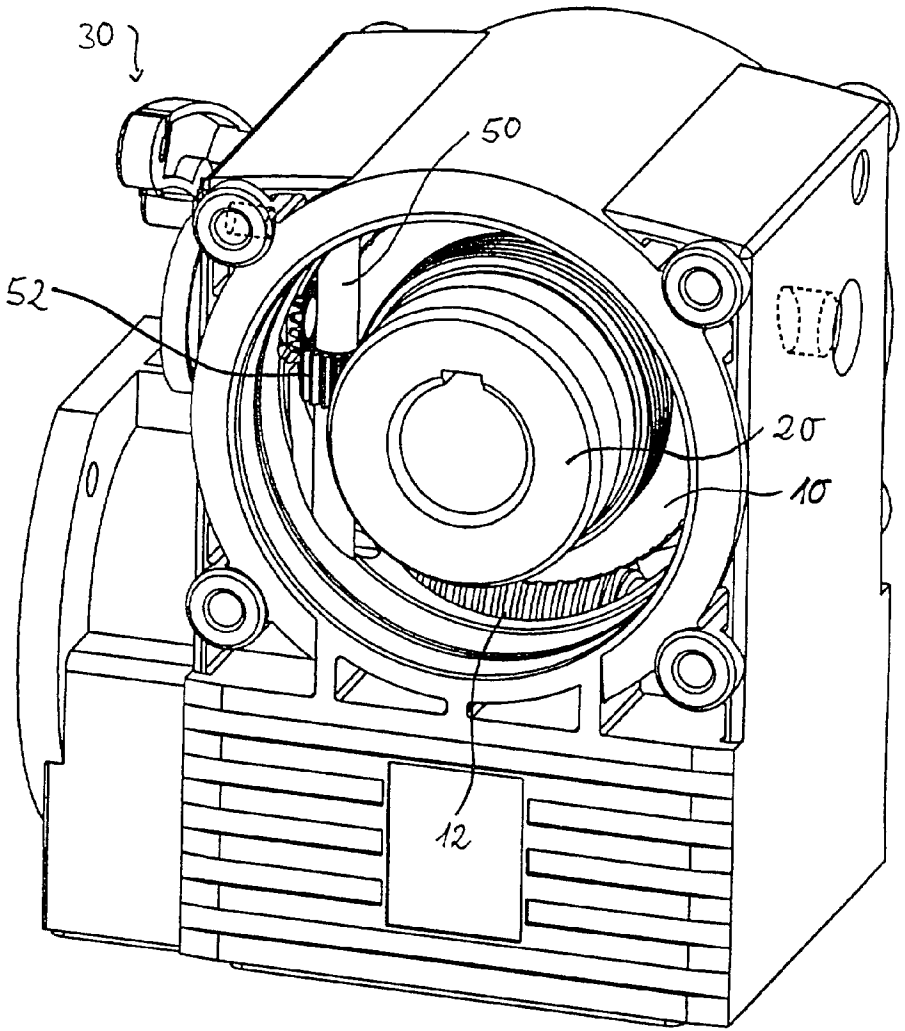
FIG. 2 is a perspective illustration of a housing part containing the important components illustrated in FIG. 1 of the inventive drive device.
Figure 4:
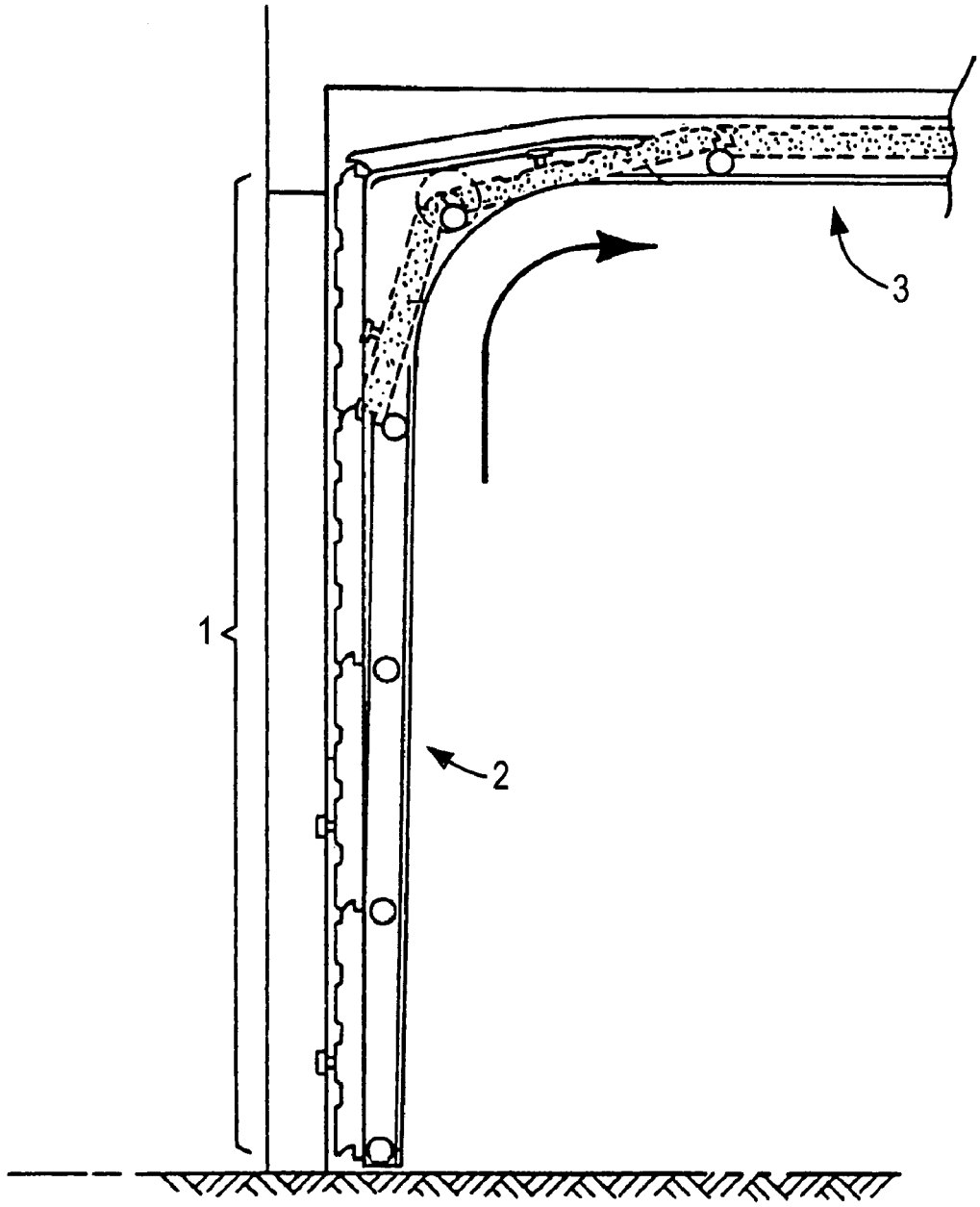
FIG. 4 is a sectional view, on a smaller scale, showing a door leaf which is movable overhead.

In FIG. 1, the output element of a drive device according to the invention embodied as a worm gear 10 is illustrated which meshes with a worm 12 (see FIG. 2) of the gear of this drive device. The worm gear 10 revolves about a drive shaft, extending coaxially thereto, for a structural component, for example, in the form of a door leaf movable overhead, as shown in FIG. 4. FIG. 4 shows the door leaf 1 in a lowered position 2 and in an overhead position 3. For example, a cable drum can be mounted on the drive shaft 20 for winding a traction means fastened on the structural component, such as a wire cable, wherein the traction means can be wound by rotation of the drive shaft onto the cable drum and in this way move the structural component or door leaf. The worm gear 10 is positive-lockingly coupled to the drive shaft by means of a coupling element 14 which is formed by a coaxially extending coupling ring so that the rotation of the worm gear 10 is transmitted onto the drive shaft 20 in the coupling position of the coupling element 14 illustrated in FIG. 1. The coupling element 14 is axially movable as illustrated in FIG. 1 by the double arrow 16.

For performing this axial movement, the device illustrated in FIG. 1 is provided with an actuating device 30. This actuating device 30 comprises essentially an actuating lever 31 which is pivotable about a pivot axis 32*a* (see FIG. 3) extending perpendicularly to the drive shaft 20 as well as a cantilever arm identified at 32 which is fastened relative to the pivot axis 32*a* eccentrically on the actuating lever 31. The cantilever arm 32 has a fork 33 which partially covers the coupling element 14 and has at its opposite ends inwardly oriented driver pins 34. The driver pins 34 are received in a groove 18 extending about the periphery of the coupling element 14. Upon pivot movement of the actuating lever 31 a translatory movement of the fork 33 takes place in the direction identified by the double arrow 16 as a result of the eccentric coupling of the cantilever arm 32; the translatory movement causes the coupling element 14 to be moved from the coupling position illustrated in FIG. 1 into a freewheeling position by means of the driver pins 34 engaging the groove 18. In this freewheeling position the drive shaft 20 is decoupled from the worm gear 10, and the drive shaft 20 and the structural component, i.e. the door leaf, coupled thereto can be moved independent from the worm gear 10 and the additional elements of the drive device coupled thereto.

For safety reasons, the above described decoupling action should be performable only in predetermined positions of the structural component. For this reason, the device illustrated in the drawing is provided with a locking member 40. This locking member 40 comprises a locking member shaft 42 extending approximately parallel to the pivot axis 32*a*, wherein the locking member shaft 42 supports on its end facing away from the drive shaft 20 (FIG. 1) a locking member disc 44 and on its end facing the drive shaft 20 a spur wheel 46. The spur wheel 46 meshes with a gear wheel 52 revolving about a control shaft 50 extending perpendicular to a plane defined by the pivot axis 32*a* and the drive shaft axis. This gear wheel 52 meshes with a rib 22 arranged helically on the drive shaft 20.

In this way, a rotational movement of the drive shaft 20 is transmitted like a worm gear movement onto the gear wheel 52 and thus also onto the locking member 40. As a result of the coupling of the control shaft 50 to the drive shaft 20 via the gear wheel 52 and the rib 22, it is achieved that a plurality of revolutions of the drive shaft are required in order to generate a complete revolution of the control shaft 50 or the locking member shaft 42. Accordingly, with this type of coupling it can be achieved that the control shaft 50 or the locking member shaft 42 during the course of the movement of the structural component along its entire movement path completes only one revolution.

Figure 3:
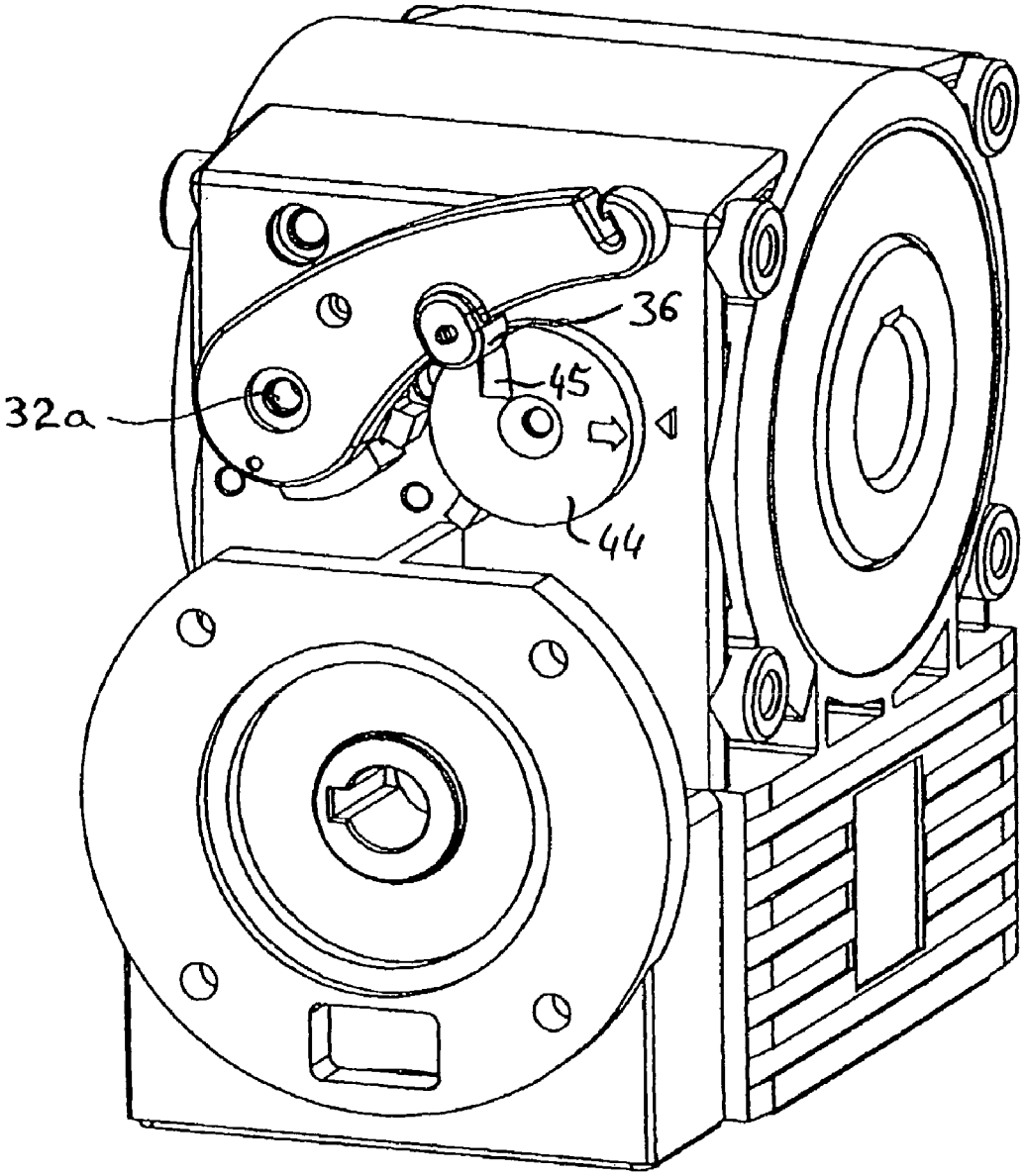
FIG. 3 is a further perspective illustration of a housing part according to FIG. 2.

As can be seen particularly clearly in FIGS. 1 and 3, the actuating lever 31 has a locking element 36 extending substantially parallel to the pivot axis 32*a* and having a pin shape which can be inserted into a groove 45 provided in the locking member disc 44 in the release position of the locking member disc 44 illustrated in FIGS. 1 and 3. When the locking member disc 44 during the course of the movement of the structural component is rotated out of the release position illustrated in FIG. 3, the pinshaped locking element 36 reaches, upon a pivot movement of the actuating lever 31, a contact position on the circumferential surface of the locking member disc 44 and prevents in this way the pivot movement or adjustment of the coupling element 14 from the coupling position illustrated in FIG. 1 into the freewheeling position. The pin-shaped locking element 36 is movable against the pretension force of a pretensioning device in a direction parallel to the pin axis and upon introduction into the groove 45 rests against the groove bottom.

As illustrated in FIG. 3, the groove bottom of the groove 45 has a ramp-shaped upward incline so that the locking element can be pivoted only against the pretension force of the pretensioning device when the locking member disc 44 is in its release position in order to effect a movement of the coupling element 14 into the release position. The locking member disc 44 can be rotated relative to the locking member shaft 42 about the locking member shaft axis and can be locked in any of its rotational positions. In this way, mounting is facilitated because the structural component can be mounted first without taking into account the rotational position of the locking member disc 44. Only after completion of mounting, the structural component is moved into the predetermined position, for example, the closed position of the structural component in the form of a door leaf, the locking member disc 44 is subsequently aligned such that the locking pin 36 can be inserted into the groove 45 and locks in this position the locking member shaft 42.

This locking action is maintained even when the coupling element 14 is moved into the freewheeling position because the movement of the locking member disc 44 is triggered by the movement of the drive shaft which can be carried out independent of the movement of the drive device.

The invention is not limited to the embodiment illustrated in the drawing. Within the context of this invention, a realization of embodiments is also considered in which the locking member allows a movement of the coupling element in more than one position, for example, in the closed position of the door leaf and in the open position of the door leaf. For this purpose, the locking member disc 44 can have more than one groove 45. Moreover, the realization of an embodiment is also considered in which the locking member comprises a pin which, in the release position, can engage a groove provided in the actuating lever 31. Also, coupling of the locking member to the drive shaft without intermediate positioning of a control shaft or of a gear wheel revolving on this control shaft is possible.

While specific embodiments of the invention have been shown and described in detail to illustrate the inventive principles, it will be understood that the invention may be embodied otherwise without departing from such principles.

What is claimed is:

1. A separating device for a door having a door leaf and a drive device for moving said door leaf overhead, said drive device comprising a gear and an output element wherein the separating device comprises:

a coupling element movable between a coupling position, in which the coupling element is adapted to couple the output element to the door leaf, and a freewheeling position, in which the output element is adapted to be uncoupled from the door leaf;

a locking member movable between at least one release position, in which the locking member is configured to allow a movement of the coupling element into the freewheeling position, and at least one locking position, in which the locking member counteracts the movement of the coupling element into the freewheeling position;

wherein the locking member is configured to be coupled to the drive device, said separating device further comprising a rotatably supported control shaft, said locking member is rotationally coupled by the control shaft to the output element and said output element is rotationally coupled to a rotatably supported drive shaft, said separating device further comprising a locking element correlated with the locking member, wherein the locking element cooperates with the locking member in the locking position of the locking member and counteracts the movement of the coupling element into the freewheeling position, said locking member having a locking disc that has a groove and said locking element has a projection configured to be introduced into the groove in the release position of the locking member.

2. The separating device according to claim 1, wherein the locking member is coupled via the coupling element to the output element.

3. The separating device according to claim 1, wherein the control shaft comprises a gear wheel and the drive shaft comprises a rib helically extending about the drive shaft, wherein the gear wheel meshes with the rib.

4. The separating device according to claim 3, further comprising a locking member shaft having a spur wheel meshing with the gear wheel of the control shaft.

5. The separating device according to claim 4, wherein the locking member is rotatable about a predetermined axis of rotation.

6. The separating device according to claim 5, wherein the the predetermined axis of rotation is an axis of the locking member shaft.

7. The separating device according to claim 1, wherein the projection is a pin.

8. The separating device according to claim 1, further comprising an actuating device for moving the coupling element, wherein the locking element is arranged on the actuating device.

9. A separating device for a door having a door leaf and a drive device for moving said door leaf overhead, said drive device comprising a gear and an output element, wherein the separating device comprises:

a coupling element movable between a coupling position, in which the coupling element is adapted to couple the output element to the door leaf, and a freewheeling position, in which the output element is adapted to be uncoupled from the door leaf;

a locking member movable between at least one release position, in which the locking member is configured to allow a movement of the coupling element into the freewheeling position, and at least one locking position, in which the locking member counteracts the movement of the coupling element into the freewheeling position;

wherein the locking member is configured to be coupled to the drive device, further comprising a rotatably supported control shaft, wherein the locking member is rotationally coupled by the control shaft to the output element, wherein the output element is rotationally coupled to a rotatably supported drive shaft for the door, further comprising a locking element correlated with the locking member, wherein the locking element, in cooperation with the locking member in the locking position of the locking member, counteracts the movement of the coupling element into the freewheeling position, further comprising an actuating device for moving the coupling element, wherein the locking element is arranged on the actuating device, wherein the actuating device comprises at least one driver engaging a groove extending peripherally about the coupling ring.

* * * * *